United States Patent [19]

Koella, III

[11] 4,016,004

[45] Apr. 5, 1977

[54] TRASH COLLECTING SYSTEM FOR OPEN-END SPINNING MACHINE

[75] Inventor: Ernest Koella, III, Rockford, Tenn.

[73] Assignee: Platt Saco Lowell Limited, England

[22] Filed: June 25, 1975

[21] Appl. No.: 590,368

[52] U.S. Cl. ..... 134/21; 15/301; 57/34.5; 57/56; 57/58.89; 57/156

[51] Int. Cl.[2] ..... B08B 5/04; D01H 11/00

[58] Field of Search ..... 134/21, 18; 15/301, 15/331, 419; 57/56, 34.5, 58.89, 156

[56] References Cited

UNITED STATES PATENTS

| | | | |
|---|---|---|---|
| 2,976,556 | 3/1961 | Reiterer | 15/301 |
| 3,628,213 | 12/1971 | Ramo | 15/301 X |
| 3,777,329 | 12/1973 | Lane | 15/301 |
| 3,839,764 | 10/1974 | Clayton | 15/301 |

*Primary Examiner*—S. Leon Bashore
*Assistant Examiner*—Richard V. Fisher
*Attorney, Agent, or Firm*—Joseph H. Heard

[57] ABSTRACT

First suction forces of relatively large magnitude and small duration, and second suction forces of relatively small magnitude and large duration, are alternatively applied to the trash outlet of each trash box of a multi-station open-end spinning machine during its operation. The large-magnitude suction forces rapidly evacuate from each box trash previously introduced therein by a beater roll disposed adjacent its inlet. The small-magnitude suction forces discourage escape of the trash from the boxes, pending evacuation thereof. Preferably the small-magnitude suction forces are applied simultaneously and substantially continuously to the outlets of all of the trash boxes, and the large-magnitude suction forces are applied successively to discrete groups of the boxes.

24 Claims, 5 Drawing Figures

TRASH COLLECTING SYSTEM FOR OPEN-END SPINNING MACHINE

BACKGROUND OF THE INVENTION

This invention relates to open-end textile spinning machines of the type having, at each spinning station thereof, a receptacle or "trash box" which receives particles of leaf, seed, dirt, fly or other trash removed by a beater roll or the like from the textile fibers being processed. The invention more particularly relates to an improved system for the collection and removal from such trash boxes of the trash deposited therein.

It has heretofore been proposed to remove trash from the trash boxes of open-end spinning machines by pneumatic suction: see, e.g., U.S. Pat. Nos. 3,839,764, 3,834,145, 3,828,539, 3,800,521, 3,797,218, 3,792,575, 3,777,466, 3,777,329 and 3,763,641. In some of the prior systems there is continuously applied, to the outlet of each trash box of the spinning machines, suction of a magnitude sufficient to continuously evacuate from the boxes the trash deposited therein. Such systems require a suction-source of considerable size, and therefore are relatively expensive from the viewpoint of both acquisition cost and operating cost. Additionally, the continuous application to the trash boxes of suction of the aforesaid magnitude may cause an excessive quantity of valuable "spinnable" fibers to be sucked into the boxes from the beater rolls adjacent thereto. In other of the prior trash removal systems, suction is applied only intermittently to the trash box outlets. The duration of the time intervals between suction-applications is quite important in systems of this type. If the intervals are of too brief a duration, one encounters problems of the above-discussed type present in connection with continuous-suction systems. On the other hand, if the time intervals between the intermittent applications of suction are of too long a duration, another problem may arise. During those intervals when suction is not being applied to the outlets of the trash boxes, the trash therein is blown about by air currents produced within the boxes by the adjacent beater rolls or other sources. Such extraneous air currents may cause trash to escape from the boxes, either by undergoing reverse-passage through the box inlets or by passing through one of the additional openings frequently provided in the trash boxes for other purposes, prior to its being withdrawn through the box outlets by the next application of suction to such outlets. Most if not all of the trash thus escaping from the trash boxes will be re-introduced into the textile fibers being processed, thereby resulting in degradation of the quality of the yarn spun therefrom. Attempted solution of the aforesaid problem by adjustment of the time intervals between successive applications of the intermittent suction is difficult since the selection of intervals of a suitable duration is dependent upon, among other things, the variable quality of the silver being processed. More frequent applications of suction will be required if the sliver is of a low-grade, "trashy" quality than if the sliver is of a better quality. A timing of the intermittent suction in a manner satisfactory for sliver of one quality therefore will not necessarily be suitable when sliver of another, different quality is processed by the same spinning machine.

OBJECTS OF THE INVENTION

The primary object of the present invention is the provision in association with a multi-station open-end spinning machine of an improved trash collecting system, of the type wherein suction forces are applied to the outlets of the trash boxes at the various stations of the spinning machine, which is highly economical to construct, install, maintain and operate, and which is highly effective and reliable in operation.

A related and more specific object is the provision of a trash collecting system of the aforesaid type which minimizes if not altogether obviates the possibility of trash escaping from the trash boxes, once deposited therein, but which at the same time does not cause significant losses of valuable "spinnable" fibers from the sliver being processed, and does not require the use of a suction-source of excessive size.

Still another object is the provision of a trash collecting system capable of effective use in the open-end spinning of different slivers of varying quality, including sliver of very poor, "trashy" quality.

SUMMARY OF THE INVENTION

The present invention provides a trash collecting system, for and in association with an open-end spinning machine having a plurality of trash boxes each possessing an inlet opening and an outlet opening, wherein first and second suction forces of widely differing magnitudes are intermittently and successively applied, preferably in alternating fashion, to the outlet of each trash box. The first suction force has a large magnitude and, during each of its intermittent applications to the outlet of a trash box, rapidly evacuates accumulated trash from the box. However, the duration of each of its intermittent application is so small that the first suction force does not cause objectionable losses of valuable spinnable fibers from the sliver being processed, and does not preclude the use of a suction-source of economical size in the system. The second suction force, which preferably is continuously applied to the outlet of each trash box during the longer-duration time intervals between intermittent applications of the first suction force, has a much smaller magnitude. Its function is to constrain trash awaiting evacuation from a trash box by application of the first suction force to the box outlet opening, and thus minimize the possibility of such trash escaping from the box through its inlet opening or the like. Notwithstanding the relatively large duration of its applications, the magnitude of the second suction force is so small as to also not preclude use in the system of an economical suction-source.

In a preferred embodiment of the invention hereinafter described in detail, the second suction force is applied almost continuously during operation of the spinning machine to the outlets of all of the machine's trash boxes, while the first suction force is applied intermittently and successively to the outlets of successive groups of the trash boxes. Such arrangement further contributes toward the economical nature of the system.

BRIEF DESCRIPTION OF THE DRAWINGS

Other features of the invention will be apparent from the following description of an illustrative embodiment thereof, which should be read in conjunction with the accompanying drawings, in which.

DESCRIPTION OF THE ILLUSTRATIVE EMBODIMENT

Figure 1:
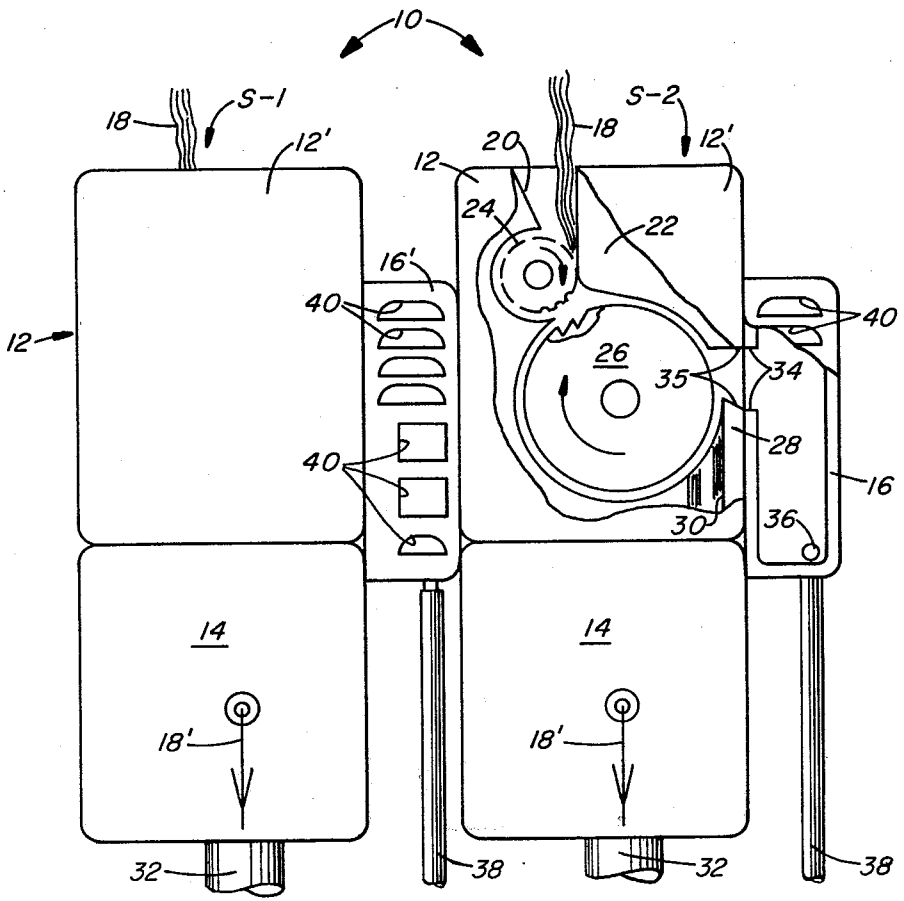
FIG. 1 PRIOR ART
FIG. 1 is a fragmentary and partially schematic front elevational view of part of a multi-delivery open-end spinning machine, some of the illustrated components of which are partially broken away to better reveal details of interior construction, in association with which the present trash collecting system might be employed.

FIG. 1 shows portions of two spinning stations S-1 and S-2 of an open-end spinning machine 10 which would conventionally have a large number, for instance one hundred, stations S each including an upper housing 12 having a cover plate 12′, a lower housing 14, and a trash box 16 having a cover plate 16′. During operation of machine 10, sliver 18 from a suitable creel (not shown) passes at each station S into upper housing 12 through an inlet 20, and then between a feed pedal 22 and a feed roll 24 to a rapidly-rotating beater roll 26. Roll 26 separates the fibers of sliver 18 and conveys them upon its wire-covered or needled peripheral surface past a stripping member 28 to a passage 30 communicating with lower housing 14. Fibers conducted to passage 30 by beater roll 26 are sucked into a spinning chamber (not shown) within lower housing 14 by pneumatic suction applied to it through a conduit 32, and there are spun into yarn 18′. The yarn 18′ leaving lower housing 14 passes through various guides, rollers and the like (not shown) to a take-up spool (not shown) upon which it is collected.

Aligned openings 34,35 are respectively provided through the confronting sidewalls of trash box 16 and upper housing 12 in laterally-adjacent relationship to that segment of beater roll 26 disposed immediately forwardly, in relation to the clockwise direction of such roll's rotative movement, of stripping member 28. Particles of seed, leaf, dirt, lint and similar trash intermingled with the fibers upon the periphery of beater roll 26 are hurled therefrom, by centrifugal force and/or by the air currents generated by the roll's rotation, into trash box 16 through openings 35,34. An outlet opening 36 (FIG. 2), with which a conduit 38 communicates, is provided within the rear wall and adjacent the bottom of box 16 for the removal therefrom of trash introduced therein. One or more viewing and/or ventilating openings 40 are provided in cover plate 16′ of box 16. Openings 40 assist to some extent in dissipating or relieving the air currents generated within box 16 by the rotating beater roll 26 closely adjacent inlet opening 34, and permit entry of ambient air into box 16 during particularly those times when suction forces are applied to its outlet opening 36.

Figure 2:
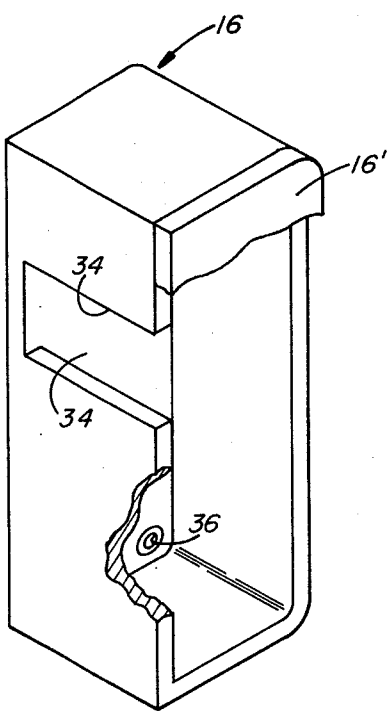
FIG. 2 PRIOR ART
FIG. 2 is an enlarged front perspective view of one of the trash boxes of the spinning machine of FIG. 1, the cover plate of the trash box being partially broken away.

The above-described components of FIGS. 1 and 2 are conventional, and are merely illustrative of one type of open-end spinning machine in association with which the improved trash collecting system of the present invention can be advantageously employed.

In accordance with the present invention, first and second suction forces of differing magnitudes, and preferably differing durations, are intermittently and successively applied to the outlet 36 of each trash box 16 through its associated conduit 38. The first suction force is of such large magnitude as to rapidly evacuate from a box 16 even large quantities of trash contained therein, but is of such brief duration as to not significantly "rob" or otherwise adversely affect the spinnable long fibers being conveyed adjacent box inlet 34 to passage 30. This result is of course highly desirable since "robbing" of such fibers deprives yarn 18′ thereof, and thus lessens the strength of such yarn, as well as constituting a waste of these usable fibers. By way of illustration, the first suction force may have a magnitude within the range of approximately 20 to 30 inches of water, and may be applied to the outlet 36 of each trash box 16 for approximately .5 to 1.5 seconds at spaced time-intervals of approximately 10 seconds. The second suction force applied to the outlet 36 of each trash box 16 preferably is applied continuously to outlets 36 of trash boxes 16 during the longer-duration time intervals between intermittent applications of the first suction force. However, the magnitude of the second suction force is so small that, notwithstanding the duration of its application being greater than that of the first suction force, it also does not rob any significant quantity of spinnable fibers from those being conveyed to passages 30. The magnitude of the second suction force may be, for example, within the range of approximately 0.5 to 2.0 inches of water. The second force is not intended to, and does not, evacuate from boxes 16 all or even any large part of the trash introduced therein through inlet openings 34. During the periods of its application, however, the second suction force overcomes the tendency of trash then accumulating within boxes 16 to be blown about in a random fashion under the impetus of air currents generated by the adjacent beater rolls 26 and/or by other extraneous devices such as blowers which might be employed in proximity to machine 10 for cleaning purposes. Instead of being blown about in the aforesaid fashion, the trash within boxes 16 is retained by the second suction force within the lower-rear areas of the boxes adjacent outlets 36. This minimizes if not altogether obviates the possibility of the trash escaping from boxes 16, pending evacuation thereof by the high-magnitude first suction force, via one of the openings 40 within covers 16′ and/or by reverse passage through inlets 34. The aforesaid result is of course highly desirable since any trash undergoing reverse-passage from a box 16 through its inlet 34 is reintroduced into the fibers being processed at the spinning station S with which such box is associated, with ensuing degradation of the yarn produced at such stations. Similarly, any trash escaping from a box 16 through one of the openings 40 within its cover 16′ may, through a more circuitous route, also subsequently be reintroduced into the sliver being processed at the same or some other spinning station S of machine 10.

Performance by the second suction force of its trash-retaining function is not dependent upon its being applied to trash-outlet 36 of a box 16, since the force would similarly prevent escape of trash from a box 16 if applied thereto at some other location within the box distal from the openings 34,40 through which trash tends to escape. It is preferred, however, that the second suction force be applied through the same outlet 36 as is employed for evacuation of the trash by the first, large-magnitude suction force, since such arrangement positions the retained trash most advantageously for rapid evacuation by the first suction force, and also enhances the structural simplicity of the apparatus of the system.

The trash collecting system may be used in association with spinning machines having either a large or small number of spinning stations S. Although the high-magnitude first suction force may be applied simultaneously to all of the trash boxes of a particular spinning machine, preferably it is applied sequentially to discrete ones or groups of the boxes. Such procedure, in conjunction with the respective brief duration and small magnitude of the first and second suction forces, permits the use in the present trash collecting system of an economical suction-source, which may be and preferably (but not necessarily) is the same as that which applies the so-called "technological" suction to the spinning chambers of the spinning machine.

Figure 3:
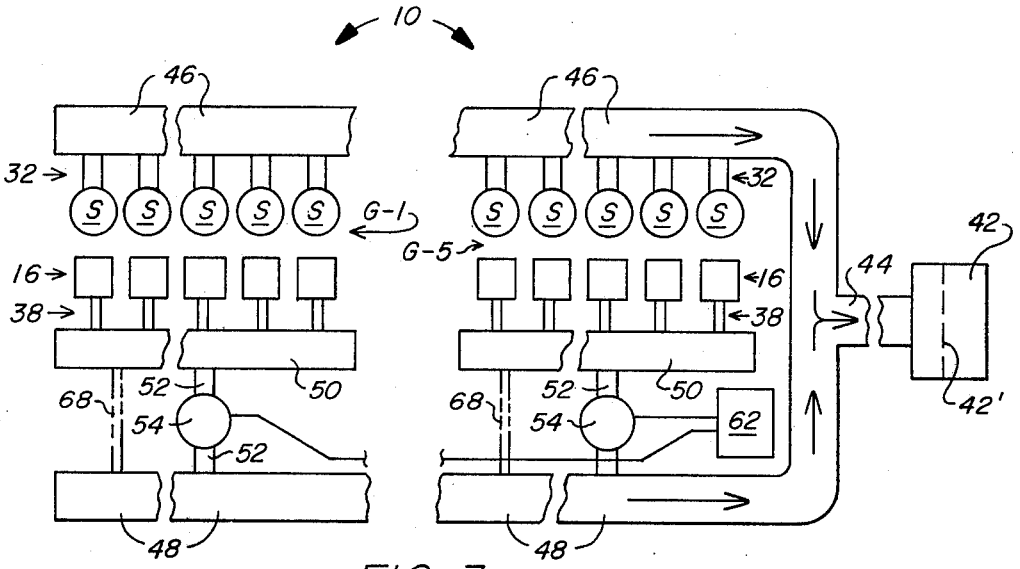
FIG. 3 is a schematic view, broken away intermediate its length, of the pneumatic-suction and electrical circuitry of the trash collecting system, and of associated pneumatic circuitry of the spinning machine of FIG. 1.
Figure 5:
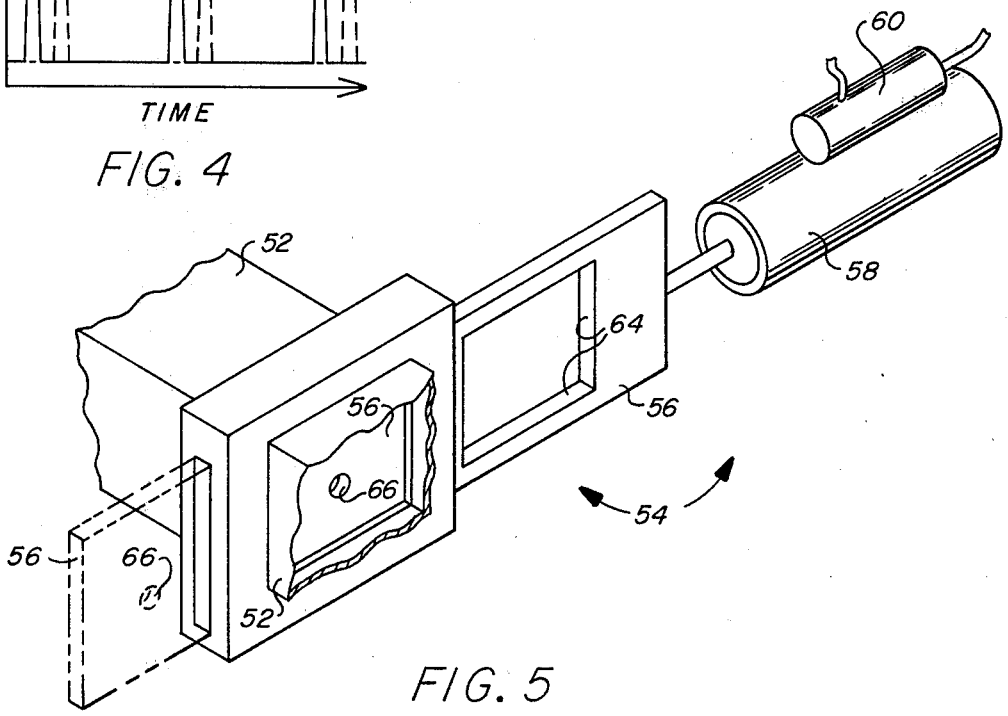
FIG. 5 is a perspective and partially schematic view of a valve assembly employable in the trash collecting system, the valve member being shown in a closed condition in solid lines and in an open condition in phantom lines.

The following description of structural components of the trash collecting system assumes, for purposes of illustration, that the associated spinning machine 10 has a total of one hundred stations S, arranged in five longitudinally-adjacent "bays" or groups G each including twenty stations S. FIG. 3 schematically shows some of the stations S of the two bays or groups G-1 and G-5 at the opposite ends of spinning machine 10. Referring still primarily to FIG. 3, the numeral 42 designates a suitable suction source connected by a main duct 44 to two branch ducts 46,48 each extending substantially the full length of machine 10. Source 42 maintains suction forces of high magnitude within ducts 44,46,48 and therefore within the conduits 32 (see also FIG. 1) extending from housings 14 of spinning stations S and connected in a conventional manner to duct 46. The conduits 38 (see also FIGS. 1 and 2) connected to outlets 36 of the trash boxes 16 associated with each group G of spinning stations S communicate with respective ones of a plurality of manifolds 50, there being one such manifold for each group G of stations S. Manifolds 50 are independently connected to duct 48 by ducts 52 having rapid-acting valve assemblies 54 associated therewith, there being one such duct 52 and valve assembly 54 for each manifold 50. As is shown in more detail in FIG. 5, each valve assembly 54 includes a plate-like gate member 56 which is reciprocatorily movable between "open" and "closed" positions across its associated duct 52 by a fluid-operated piston and cylinder unit 58 actuable by a pilot valve 60 in response to electrical signals received from a suitable timing device 62 schematically shown in FIG. 3. Gate member 56 has therein a large opening 64 and a much smaller "bleed" opening 66. Movement of gate member 56 to its "open" position, indicated in phantom lines in FIG. 5, brings its large opening 64 into alignment with duct 52, thereby establishing full communication between associated manifold 50 and the duct 48 (FIG. 3) connected via main duct 44 to suction source 42. This applies the previously-discussed first suction force, which is of approximately the same large magnitude as within duct 48, to outlets 36 of the trash boxes 16 in the particular group G of spinning stations S having trash-box outlet conduits communicating with manifold 50. Movement of gate member 56 of valve assembly 54 to its "closed" position, shown in solid lines in FIG. 5, limits communication between duct 48 and manifold 50 to that permitted by the small bleed opening 66 within gate member 56. Closure of valve assembly 54 therefore terminates the aforesaid application of the large-magnitude suction to outlets 36 of the boxes 16, and substantially simultaneously applies to such outlet the previously-discussed second suction force of small magnitude.

In lieu of the bleed opening 66, other by-pass means could of course be employed for similarly creating the desired suction force of low magnitude within manifold 50 when valve assembly 54 is not in its open condition. For example, the throw of piston and cylinder unit 58 might be so adjusted as to leave at such time a slight gap between the terminal edge of gate member 56 and the adjacent wall of duct 52. Or, as is indicated in phantom lines in FIG. 3, a separate bleed line 68 might be provided between duct 48 and each manifold 50.

Figure 4:
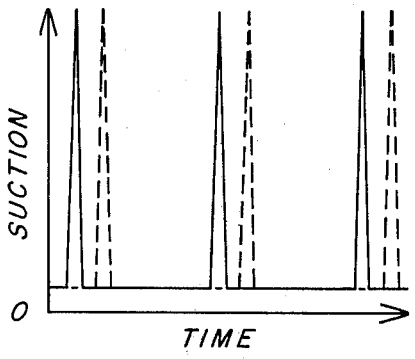
FIG. 4 is a graph, not to scale, diagramatically illustrating the varying suction forces intermittently and successively applied by the trash collecting system to the trash boxes of the spinning machine during operation thereof.

Timing device 62 (FIG. 3) is so programmed that valve assemblies 54 are opened only momentarily and, preferably, sequentially. Such programming of timing device 62 is reflected by the graph (not to scale) of FIG. 4, wherein the solid line indicates the suction forces applied to the outlets 36 of the trash boxes 16 in group G-1 of spinning stations S, and the dash line indicates the suction forces applied to the boxes 16 in group G-5 of spinning stations S. The "peaks" of the suction forces applied to the boxes 16 in each additional group G of spinning stations S would similarly be displaced from one another.

Trash removed from boxes 16 of machine 10 by the suction forces applied thereto passes to suction source 42, via the previously-described conduits 38, manifolds 50, and ducts 52,48, and is there removed from the entraining air by suitable filtering means 42' (FIG. 3) or the like associated with source 42.

While a preferred embodiment of the invention has been specifically shown and described, it is to be understood that this was for purposes of illustration only, and not for purposes of limitation, the scope of the invention being in accordance with the following claims.

Further, while the described embodiment concerns use of the principle of this invention, namely the means for and method of using a relatively high suction for intermittant and brief intervals of time to remove trash and relatively low suction for those intervals intermediate the times of application of the relatively high suction in order to keep incoming trash within a trash box retained within a certain spacial locus and preferably adjacent the trash outlet opening of the box, with open-end spinning machines, the present means and method have been successfully employed for trash removal from trash boxes on carding machines, and also may be applicable for trash removal from trash boxes on openers.

I claim:

1. In combination with an open-end spinning machine including a trash box having a trash-inlet opening and a trash-outlet opening therein, an improved method for collecting trash introduced into said box through said inlet, comprising:

intermittently evacuating, at successive periodic times, trash from said box through said outlet;

and at other times applying to trash within said box a suction force adapted and effective to then retain the trash within said box and discourage possible reverse-passage of the trash through said inlet.

2. A method as in claim 1, wherein said suction force is applied throughout substantially all of each of the intervals between intermittent evacuations of trash from said box.

3. A method as in claim 1, wherein said suction force is applied to said trash box from, and substantially retains said trash within, a part of said box distal from said inlet.

4. A method as in claim 1, wherein said suction force is applied through said outlet and the magnitude of said suction force is insufficient to effect removal of appreciable quantities of trash through said outlet.

5. A method as in claim 4, wherein said step of evacuating trash from said box includes intermittently applying to said outlet a trash-evacuating suction force having a large magnitude and small duration in relation to said first-mentioned suction force.

6. In combination with a textile fiber processing machine including a trash box having means defining a plurality of openings including a trash-outlet opening therein, an improved method for collecting trash introduced into said box, comprising:

successively applying first and second intermittent suction forces of different magnitudes and different durations relative one another to said outlet opening of said trash box, said first of said suction forces having a preselected large magnitude and each application thereof being of preselected small duration, said second of said suction forces having a preselected small magnitude and being applied to said outlet opening during at least a major part of each of the intervals between intermittent applications of said first of said suction forces to said outlet opening.

7. A method as in claim 6, wherein said first suction forces rapidly evacuates trash from said box through said outlet opening when applied thereto, and wherein said second of said suction forces retains trash within said box pending evacuation thereof by said first suction force, and then discourages escape of trash through another of said openings of said box.

8. A method as in claim 6, wherein said second of said suction forces is applied substantially continuously to said outlet opening during each of the intervals between intermittent applications of said first of said suction forces to said outlet opening.

9. In combination with a textile fiber processing machine including a trash box having means defining a plurality of openings including a trash-outlet opening therein, improved apparatus for collecting trash introduced into said box, comprising:

means for intermittently applying to said trash-outlet opening of said trash box a suction force of preselected large magnitude and brief duration; and means for intermittently applying to said trash-outlet opening of said trash box, during at least a major part of each of the intervals between intermittent applications to said trash-outlet opening of said first mentioned suction force, a suction force of preselected small magnitude and different duration in relation to the magnitude and duration of said first mentioned suction force.

10. In combination with a multi-station open-end spinning machine including a plurality of trash boxes arranged in groups and each having means defining a trash outlet therein, improved apparatus for collecting trash introduced into said boxes, comprising:

means for applying, intermittently to said outlet of each of said trash boxes and simultaneously to the said boxes of each of said groups and sequentially to the said boxes of different ones of said groups, a suction force of preselected large magnitude and small duration; and means for intermittently applying to said outlet of each of said trash boxes, during at least a major part of each of the intervals between intermittent applications thereto of said first mentioned suction force, a suction force of preselected small magnitude and different duration in relation to the magnitude and duration of said mentioned suction force.

11. In combination with a textile fiber processing machine including a trash box having means defining a plurality of openings including a trash-outlet opening therein, improved apparatus for collecting trash introduced into said box, comprising:

trash-evacuating suction means communicating with said trash-outlet opening of said trash box for intermittently applying to said trash-outlet opening of said trash box a suction force of preselected large magnitude and small duration effective to rapidly evacuate trash from said box; and trash-retaining suction means communicating with said trash-outlet opening of said trash box for applying to said trash-outlet of said trash box, during at least a major part of each of the intervals between intermittent applications of said first mentioned suction force to said trash-outlet opening, a suction force of preselected small magnitude effective to retain trash within said box pending evacuation thereof by said first mentioned suction force and to discourage escape of trash through another of said openings of said box.

12. In combination with a textile fiber processing machine including a trash box having means defining a plurality of openings including a trash-outlet opening therein, improved apparatus for collecting trash introduced into said box, comprising:

first suction means for intermittently applying to said trash-outlet opening of said trash box a suction force of preselected large magnitude and small duration; and second suction means for intermittently applying to said trash-outlet opening of said trash-box, substantially continuously during the intervals between intermittent applications to said trash-outlet opening of said first mentioned suction force, a suction force of preselected small magnitude and different duration in relation to the magnitude and duration of said first mentioned suction force.

13. In combination with an open-end spinning machine including a trash box having means defining a trash-inlet opening and a trash-outlet opening therein, improved apparatus for collecting trash introduced into said box through said inlet, comprising:

intermittently-operable trash-evacuating means for at periodic times evacuating trash from said box through said outlet;

and trash-retaining means for at other times applying to trash within said box a suction force sufficient to then discourage possible reverse-passage of the trash through said inlet.

14. Apparatus as in claim 13, wherein said trash-retaining means communicates with, and retains trash within, a part of said box distal from said inlet.

15. Apparatus as in claim 14, wherein said box includes at least one additional opening therein, and wherein said part of said box within which trash is retained by said suction force is distal from said additional opening and adjacent said outlet.

16. Apparatus as in claim 13, wherein said trash-evacuating means and said trash-retaining means both communicate with said outlet of said box, and wherein the magnitude of said suction force is insufficient to effect removal of appreciable quantities of trash through said outlet.

17. In combination with an open-end spinning machine including a trash box having means defining a trash-inlet opening and a trash-outlet opening therein, improved apparatus for collecting trash introduced into said box through said inlet, comprising:

intermittently-operable trash-evacuating means for at periodic times evacuating trash from said box through said outlet;

and trash-retaining means for applying to trash within said box, throughout substantially all of each of the intervals between intermittent evacuations of trash from said box by said trash-evacuating means, a suction force sufficient to then discourage possible reverse-passage of the trash through said inlet.

18. In combination with an open-end spinning machine including at least two trash boxes each having means defining a trash outlet therein, improved means for at desired times applying suction forces to said outlets of said trash boxes, comprising:

suction means;

pneumatic circuit means interconnecting said suction means and said outlets of said trash boxes; said pneumatic circuit means including first and second manifold members; said first of said manifold members communicating with said outlet of one of said trash boxes; and said second of said manifold members communicating with said outlet of another of said trash boxes; normally-closed first and second valve means interposed between said suction means and respective ones of said first and second manifold members for, when opened, establishing communication of relatively large magnitude between said suction source and said manifold members;

control means for during operation of said machine periodically and momentarily opening said first and second valve means in successive relationship to each other;

said pneumatic circuit means further including by-pass means for maintaining communication of relatively small magnitude between said suction means and said manifold members while said valve means are closed.

19. In combination with an open-end spinning machine including a trash box having means defining a trash-inlet opening and a trash-outlet opening therein, improved apparatus for collecting trash introduced into said box through said inlet, comprising:

intermittently-operable trash-evacuating means communicating with said outlet of said box for at periodic times evacuating trash from said box through said outlet by applying to said outlet a trash-evacuating suction force;

and trash-retaining means communicating with said outlet of said box for at other times applying to trash within said box a suction force sufficient to then discourage possible reverse-passage of the trash through said inlet and insufficient to effect removal of appreciable quantities of trash through said outlet;

said trash-evacuating suction force applied by said trash-evacuating means having a large magnitude and small duration in relation to said suction force applied by trash-retaining means.

20. Apparatus as in claim 19, wherein said trash-evacuating means and said trash-retaining means include suction means, and pneumatic circuit means interconnecting said suction means and said outlet of said box.

21. Apparatus as in claim 20, wherein said pneumatic circuit means includes valve means, and control means for selectively establishing first and second operating conditions of said valve means, said pneumatic circuit means applying said trash-evacuating suction force to said box outlet in said first of said operating conditions of said valve means, and applying said trash-retaining suction force to said box outlet in said second of said operating conditions of said valve means.

22. Apparatus as in claim 21, wherein said valve means includes a movable valve-gate member providing restricted communication between said suction means and said box outlet when said valve means is in its second operating condition, said member being formed with a large opening therein providing communication between said suction means and said box outlet when said valve means is in its first operating condition.

23. Apparatus as in claim 21, wherein said control means includes a timing device for successively and periodically effecting changes in said operating conditions of said valve means.

24. In combination with a multi-station open-end spinning machine including a plurality of groups of trash boxes having means defining trash inlets and trash outlets therein, improved apparatus for collecting trash introduced into said boxes through said inlets, comprising:

suction means;

pneumatic circuit means interconnecting said suction means and said outlets of said trash boxes for alternately and intermittently applying to said outlets first suction forces of preselected large magnitude effective to rapidly evacuate trash from said boxes, and second suction forces of preselected small magnitude effective to retain trash within said boxes and minimize escape of trash from said boxes pending evacuation of the trash from said boxes by said first suction forces;

said circuit means including a plurality of manifolds associated with respective ones of said groups of said trash boxes, and conduit means interconnecting and establishing free communication between each of said manifolds and said outlets of said trash boxes of the associated one of said groups;

a plurality of valve assemblies associated with respective ones of said manifolds, each of said valve assemblies forming a part of said circuit means between the associated one of said manifolds and said suction means, said circuit means applying said first and second suction forces respectively to said manifolds and to said outlets of said trash boxes in communication therewith when said valve assemblies are respectively in an open condition and in a closed condition;

and means for normally maintaining said valve assemblies in a closed condition and for periodically causing said assemblies, one at a time and in succession, momentarily to be in an open condition.

* * * * *